US011001406B2

(12) United States Patent
Hwang

(10) Patent No.: US 11,001,406 B2
(45) Date of Patent: May 11, 2021

(54) FOLDABLE BOX HAVING ADHESIVE WING PORTIONS

(71) Applicant: WINGBOX Co., Ltd, Siheung-si (KR)

(72) Inventor: Kyu Chan Hwang, Seoul (KR)

(73) Assignee: WINGBOX Co., Ltd, Siheung-si (KR)

( * ) Notice: Subject to any disclaimer, the term of this patent is extended or adjusted under 35 U.S.C. 154(b) by 0 days.

(21) Appl. No.: 16/604,165

(22) PCT Filed: Apr. 17, 2018

(86) PCT No.: PCT/KR2018/004412
§ 371 (c)(1),
(2) Date: Oct. 10, 2019

(87) PCT Pub. No.: WO2019/017571
PCT Pub. Date: Jan. 24, 2019

(65) Prior Publication Data

US 2020/0122878 A1 Apr. 23, 2020

(30) Foreign Application Priority Data

Jul. 18, 2017 (KR) ..... 10-2017-0091089

(51) Int. Cl.
*B65D 5/02* (2006.01)
*B65D 5/42* (2006.01)
(Continued)

(52) U.S. Cl.
CPC ..... *B65D 5/0236* (2013.01); *B65D 5/4266* (2013.01); *B65D 5/6605* (2013.01);
(Continued)

(58) Field of Classification Search
CPC .. B65D 5/0236; B65D 5/4266; B65D 5/6605; B65D 5/0227; B65D 5/4279; B65D 5/22;
(Continued)

(56) References Cited

U.S. PATENT DOCUMENTS 1,301,310 A * 4/1919 Paroubek ..... B65D 5/643 229/125.41
4,034,909 A * 7/1977 Toda ..... B65D 5/36 229/117
(Continued)

FOREIGN PATENT DOCUMENTS

KR 10-1998-0025252 A 7/1998
KR 20-0323165 Y1 8/2003
(Continued)

OTHER PUBLICATIONS

International Search Report of PCT/KR2018/004412 dated Jul. 26, 2018 from Korean Intellectual Property Office.

*Primary Examiner* — Christopher R Demeree
(74) *Attorney, Agent, or Firm* — Revolution IP, PLLC

(57) ABSTRACT

A foldable includes side members formed as a transverse central portion of the board, and folded respectively to form side surfaces of the box; an upper member formed to extend in an upper direction of the side members, and divided by a cutting line along a folding direction to form an upper surface of the box; and a lower member formed to extend in a lower direction of the side members, and divided by a cutting line along a folding direction to form a lower surface of the box.

10 Claims, 8 Drawing Sheets

(51) Int. Cl.

| | |
|---|---|
| ***B65D 5/66*** | (2006.01) |
| *B31B 120/30* | (2017.01) |
| *B31B 50/62* | (2017.01) |
| *B31B 110/35* | (2017.01) |
| *B31B 50/26* | (2017.01) |

(52) U.S. Cl.
CPC ..... *B31B 50/26* (2017.08); *B31B 50/624* (2017.08); *B31B 2110/35* (2017.08); *B31B 2120/302* (2017.08)

(58) Field of Classification Search
CPC . B65D 5/6602; B31B 70/8122; B31B 70/813; B65B 2210/04
USPC ..... 229/128, 125.39, 136, 132, 142
See application file for complete search history.

(56) References Cited

U.S. PATENT DOCUMENTS

| | | | | | |
|---|---|---|---|---|---|
| 4,556,167 | A * | 12/1985 | Fox | B65D 5/4283 | 229/125.39 |
| 9,469,430 | B2 * | 10/2016 | Ram | B65D 5/3621 | |
| 9,499,309 | B2 * | 11/2016 | Zerfas | B65D 75/44 | |
| 2015/0360433 | A1 * | 12/2015 | Feijen | B31B 50/74 | 53/456 |

FOREIGN PATENT DOCUMENTS

| | | | |
|---|---|---|---|
| KR | 10-1108653 | B1 | 2/2012 |
| KR | 10-1185499 | B1 | 7/2012 |
| KR | 20-2013-0005174 | U | 8/2013 |
| KR | 10-2017-0005956 | A | 1/2017 |

* cited by examiner

FOLDABLE BOX HAVING ADHESIVE WING PORTIONS

TECHNICAL FIELD

The present invention relates to a foldable box. More particularly, the invention relates to a foldable box having an adhesive wing portion, in which an outwardly protruding adhesive wing portion is formed on a folding part of each of upper and lower surfaces, thus allowing the box to be shielded without separate tools.

BACKGROUND ART

Generally, in order to prevent a product from being damaged in the process of selling and distributing the product, it is packaged using a paper or plastic box As illustrated in FIG. 1, a packing box is manufactured by forming folding lines in a predetermined shape on a board and then folding the board along the folding lines. After a user folds the cut board to make the box, a product is put into the box and the box is shielded using adhesive tape.

Such a conventional method is problematic in that the box should be made by folding the board along the folding lines in a state where a side of the box is attached through an adhesive method, and then adhesive tape should be used to shield an upper end of the box.

Meanwhile, in order to solve the above-mentioned problem, Korean Patent No. 10-1185499 is proposed, which illustrates a product packing box configured such that a product is packed by assembling while using a minimum of attachment and an upper portion is shielded using a fitting method.

According to the related art, an open surface of the box may be shielded using the fitting method, so that the open surface may be repeatedly opened or closed. However, the related art is problematic in that a sufficient shielding force cannot be ensured against load acting in a direction where the open surface of the box may be opened by the load of contents in a box piling direction.

Therefore, this is not suitable for use when the piling direction is variable such as a packing box for moving.

DISCLOSURE

Technical Problem

Accordingly, the present invention has been made keeping in mind the above problems occurring in the related art, and is intended to provide a foldable box which may be shielded at upper and lower ends of the box without a separate tool, when a product is packed.

Furthermore, the present invention provide a foldable box having an adhesive wing portion, in which the adhesive wing portion is formed using a part of an adjacent member, so that a holding rate of a board is reduced.

Technical Solution

In order to accomplish the above-described objects, the present invention provides a foldable box having an adhesive wing portion, configured to form a rectangular box by cutting and folding one sheet of a board made of a paper or synthetic resin material, the foldable box including side members formed as a transverse central portion of the board, and folded respectively to form side surfaces of the box; an upper member formed to extend in an upper direction of the side members, and divided by a cutting line along a folding direction to form an upper surface of the box; and a lower member formed to extend in a lower direction of the side members, and divided by a cutting line along a folding direction to form a lower surface of the box, wherein adhesive wing portions, attached to the side members during shielding of upper and lower parts of the box, are extendedly formed on a side surface of at least one among the upper member and the lower member.

The side member may include a pair of long-side side members spaced apart from each other to form long side surfaces when the box is folded; and a pair of short-side side members formed on side surfaces of the long-side side members to form short side surfaces, wherein an adhesive part may be formed on a side of each of the long-side side members or a side of each of the short-side side members to be attached to the short-side side member or the long-side side member while being in contact with the long-side side member or the short-side side member when the box is folded.

The upper member and the lower member may include a long-side upper member and a long-side lower member extending upwards and downwards from the long-side side member, respectively; and a short-side upper member and a short-side lower member extending upwards and downwards from the short-side side member, respectively, and the adhesive wing portion attached to each of the side members may be extendedly formed on at least one of the long-side upper member and the long-side lower member or the short-side upper member and the short-side lower member.

The adhesive wing portion may be formed using a cut surface that is cut from each of the short-side upper member and the short-side lower member adjacent to the long-side upper member and the long-side lower member.

The extension length of the adhesive wing portion may be equal to or less than a half of a width of each of the upper and lower members.

The adhesive wing portion may be formed in a multi-layered structure such that a width thereof is reduced from a coupling end of each of the long-side upper member and the long-side lower member to an outer end so as to increase an adhesive area, when the upper and lower surfaces of the box are shielded.

The adhesive wing portion may be diagonally formed such that a width thereof is reduced from the coupling end of each of the long-side upper member and the long-side lower member to the outer end and thereby the adhesive end converges on a point when the upper and lower surfaces of the box are shielded.

An adhesive member having an adhesive force may be provided on an inner surface of the adhesive wing portion or an outer surface of the short-side side member to attach the adhesive wing portion to the short-side side member, and the adhesive member may be adhesive tape to which an adhesive is applied and which is attached to the short-side side member.

A detachable adhesive member may be provided on the inner surface of the adhesive wing portion to attach the adhesive wing portion to the short-side side member, the side member may include a fixing member coupled to the adhesive member at a point which the foldable wing portion is in surface contact with, when the box is folded, and each of the adhesive member and the fixing member may be Velcro tape formed of a hook surface or a ring surface.

A detachable adhesive member may be provided on the adhesive member to fix the adhesive wing portion to the short-side side member, the fixing member may be provided on the side member to which the adhesive member is fixed at a point which the foldable wing portion is in surface contact with, when the box is folded, and the adhesive member and the fixing member may include snap buttons composed of a female snap button having a coupling hole or a male snap button having a coupling step, respectively.

The adhesive wing portion may be formed using a cut surface that is cut from each of the long-side upper member and the long-side lower member adjacent to the short-side upper member and the short-side lower member.

The extension length of the adhesive wing portion may be equal to or less than a height of each of the short-side upper member and the short-side lower member.

An adhesive member having an adhesive force may be provided on an inner surface of the adhesive wing portion or an outer surface of the long-side side member to attach the adhesive wing portion to the long-side side member, and the adhesive member may be adhesive tape to which an adhesive is applied and which is attached to the long-side side member.

A detachable adhesive member may be provided on the inner surface of the adhesive wing portion to attach the adhesive wing portion to the long-side side member, the long-side side member may include a fixing member coupled to the adhesive member at a point which the foldable wing portion is in surface contact with, when the box is folded, and each of the adhesive member and the fixing member may be Velcro tape formed of a hook surface or a ring surface.

A detachable adhesive member may be provided on the adhesive member to fix the adhesive wing portion to the short-side side member, the fixing member may be provided on the long-side side member to which the adhesive member is fixed at a point which the foldable wing portion is in surface contact with, when the box is folded, and the adhesive member and the fixing member may include snap buttons composed of a female snap button having a coupling hole or a male snap button having a coupling step, respectively.

The fixing member may be provided on the long-side upper member and the long-side lower member or the short-side upper member and the short-side lower member formed by extending the adhesive wing portion at a position where the adhesive wing portion is in contact.

Advantageous Effects

As described above, the foldable box having the adhesive wing portion according to the preferred embodiment of the present invention may have the following effects.

That is, the present invention is advantageous in that the box is shielded using the adhesive wing portion, so that the upper or lower end of the box may be shielded without using separate adhesive tape, and thus usability can be increased.

Furthermore, the present invention is advantageous in that the adhesive wing portion is formed using a part of the adjacent member, so that the holding rate of the board is reduced.

BEST MODE FOR THE INVENTION

An embodiment of the present invention provides a foldable box having an adhesive wing portion, configured to form a rectangular box by cutting and folding one sheet of a board made of a paper or synthetic resin material, the foldable box including side members formed as a transverse central portion of the board, and folded respectively to form side surfaces of the box; an upper member formed to extend in an upper direction of the side members, and divided by a cutting line along a folding direction to form an upper surface of the box; and a lower member formed to extend in a lower direction of the side members, and divided by a cutting line along a folding direction to form a lower surface of the box, wherein adhesive wing portions, attached to the side members during shielding of upper and lower parts of the box, are extendedly formed on a side surface of at least one among the upper member and the lower member, and wherein the side member includes a pair of long-side side members spaced apart from each other to form long side surfaces when the box is folded; and a pair of short-side side members formed on side surfaces of the long-side side members to form short side surfaces, wherein an adhesive part is formed on a side of each of the long-side side members or a side of each of the short-side side members to be attached to the short-side side member or the long-side side member while being in contact with the long-side side member or the short-side side member when the box is folded, and wherein the upper member and the lower member include a long-side upper member and a long-side lower member extending upwards and downwards from the long-side side member, respectively; and a short-side upper member and a short-side lower member extending upwards and downwards from the short-side side member, respectively, wherein the adhesive wing portion attached to each of the side members is extendedly formed on at least one of the long-side upper member and the long-side lower member or the short-side upper member and the short-side lower member.

DETAILED DESCRIPTION OF THE INVENTION

Hereinafter, the configuration of the preferred embodiment of the present invention will be described with reference to the accompanying drawings.

Figure 1:
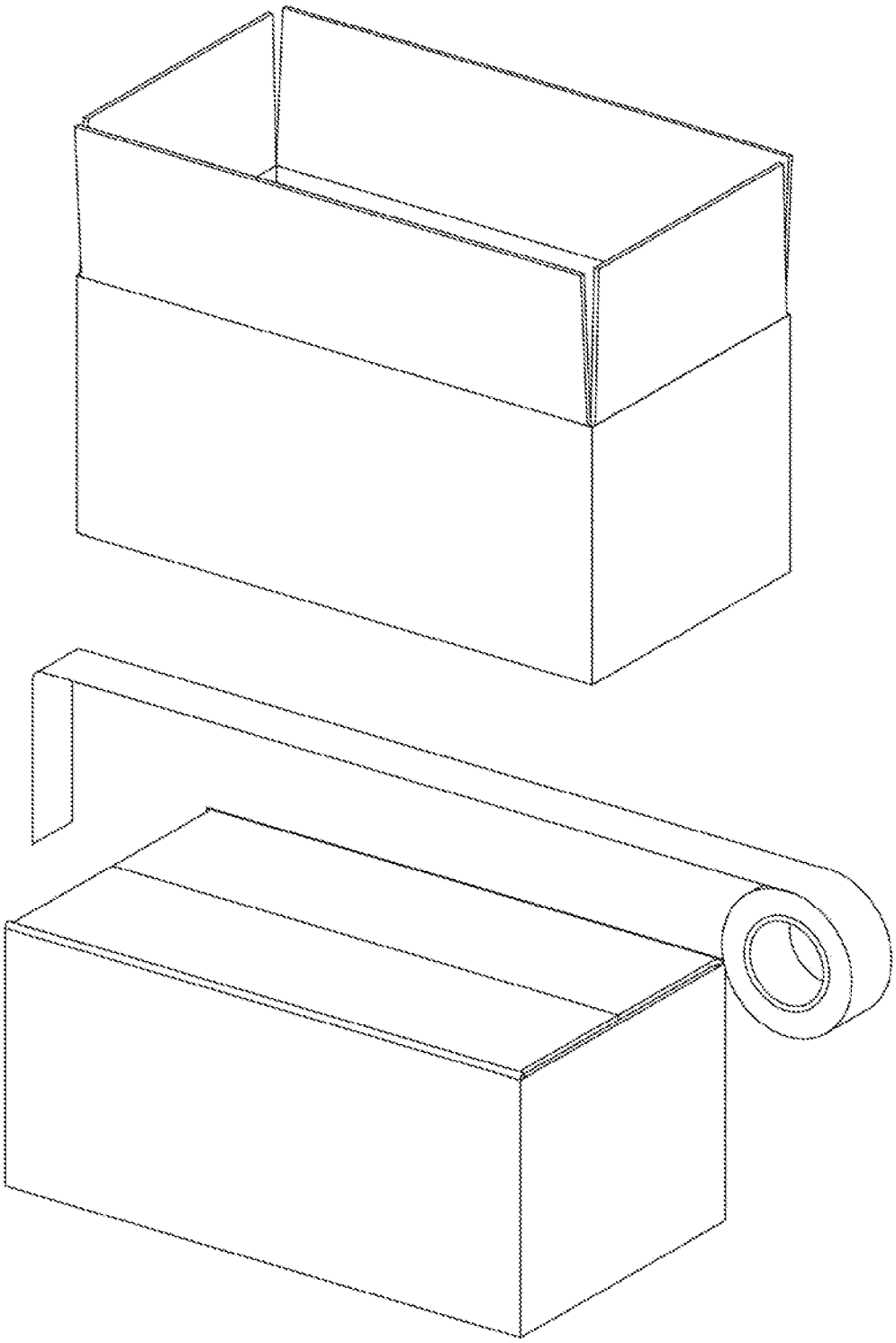
FIG. 1 is a view illustrating a conventional box.
Figure 2:
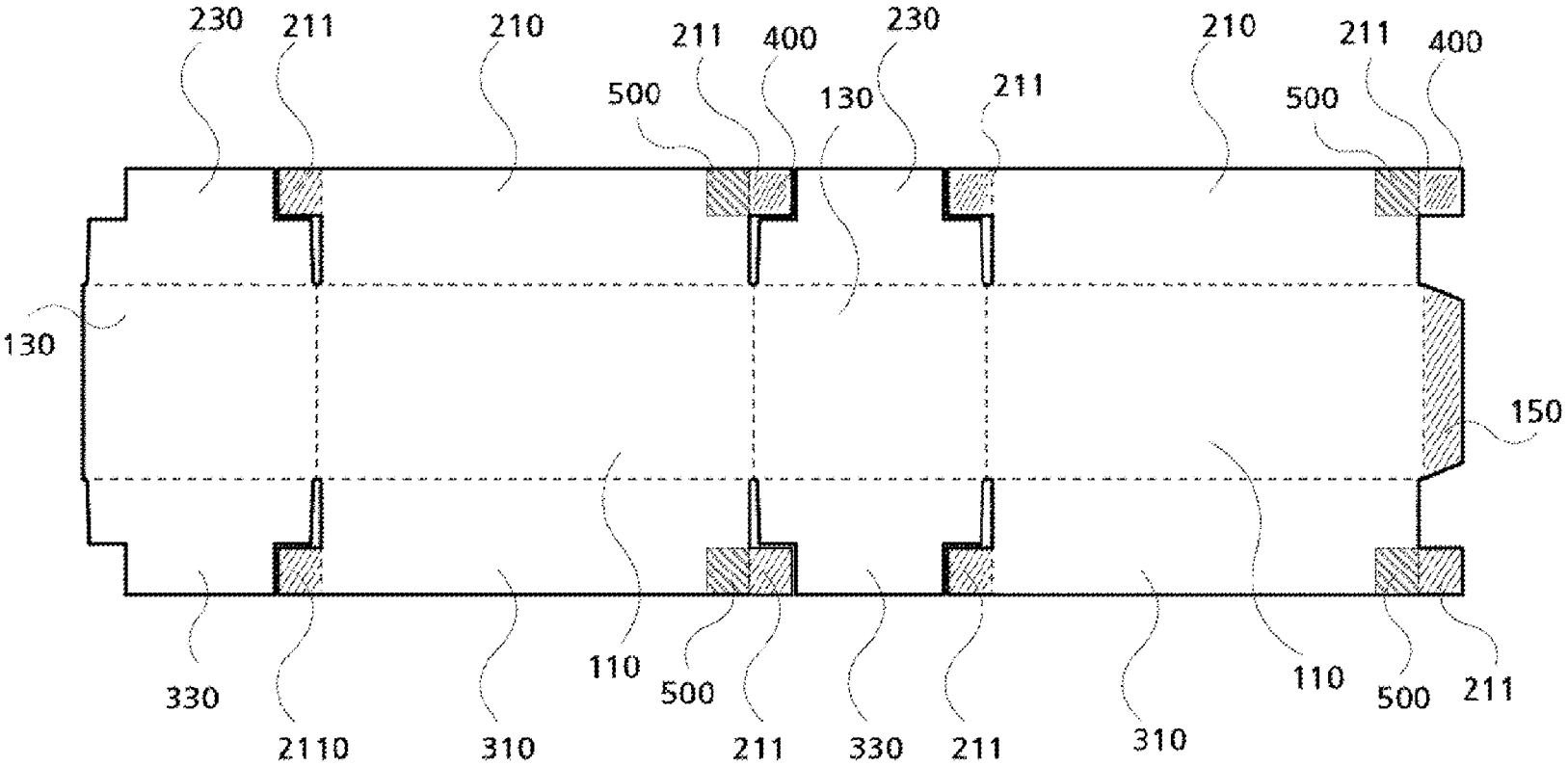
FIG. 2 is a development view illustrating a foldable box having an adhesive wing portion according to a preferred embodiment of the present invention.
Figure 3:
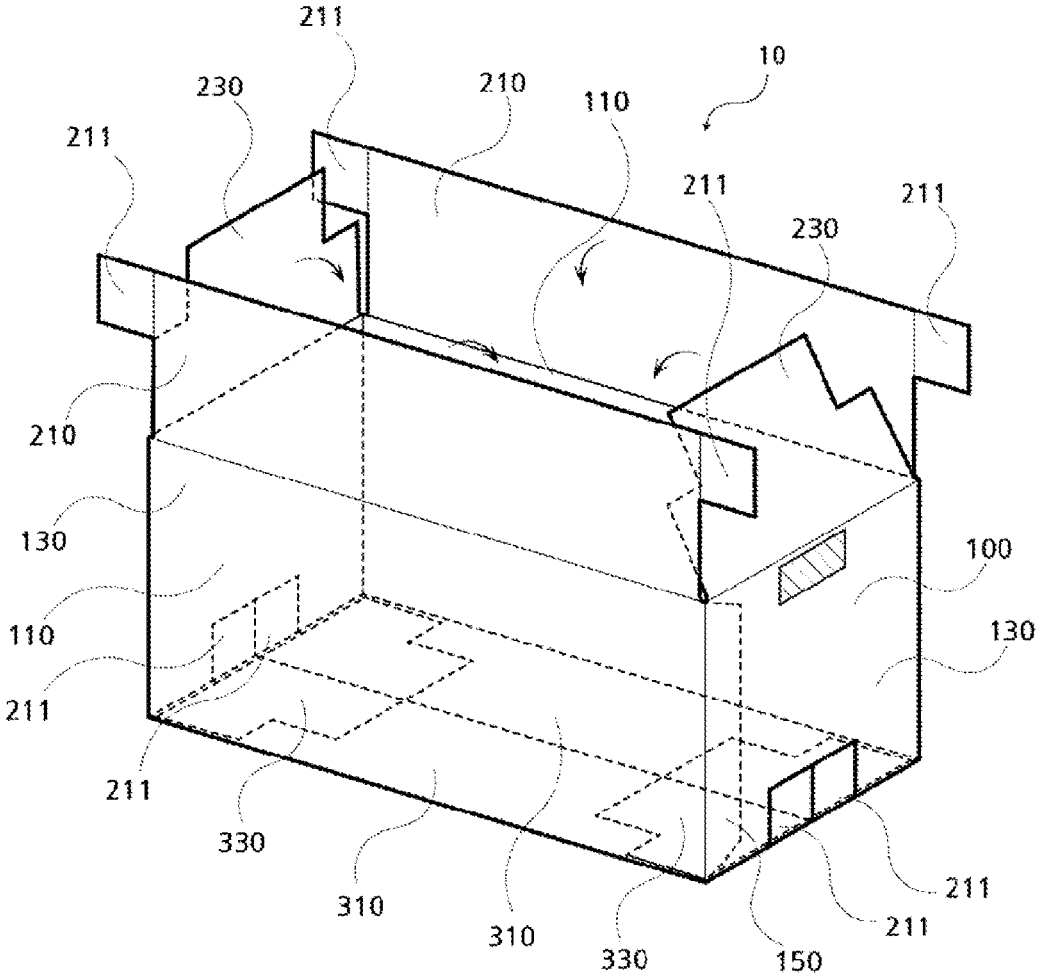
FIG. 3 is a perspective view illustrating a state where the foldable box having the adhesive wing portion according to the preferred embodiment of the present invention is folded.
Figure 4:
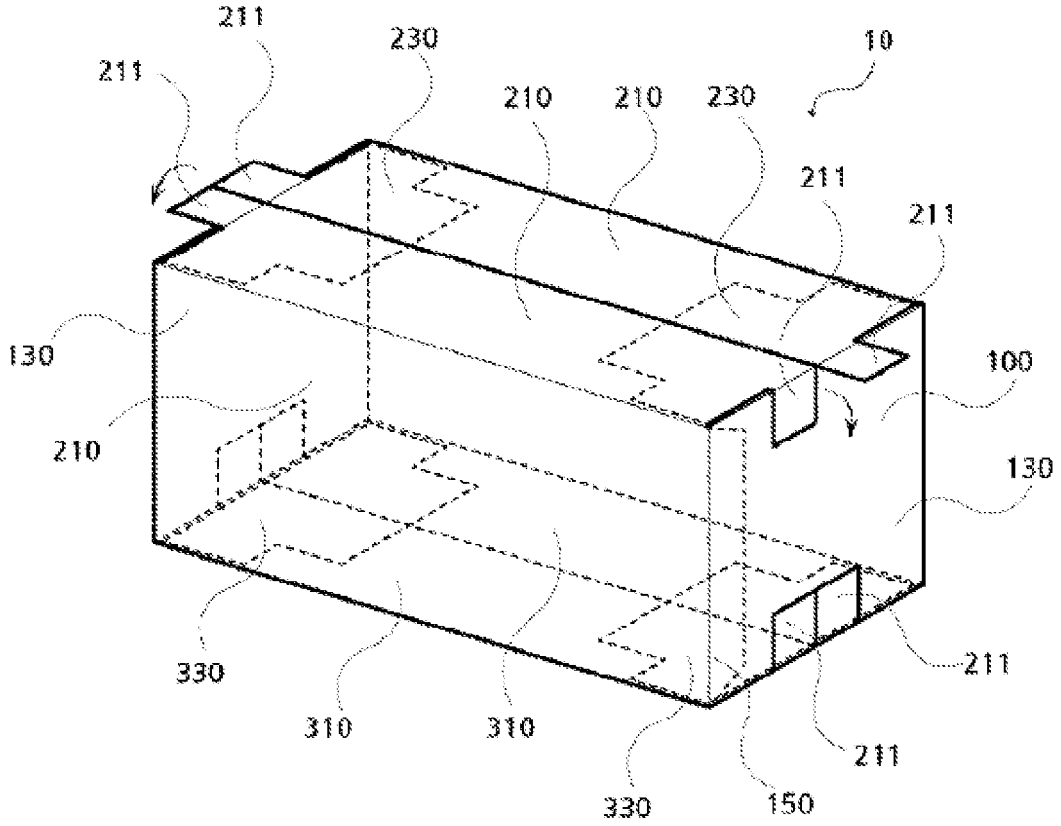
FIG. 4 is a perspective view illustrating a state where upper and lower ends of the foldable box having the adhesive wing portion according to the preferred embodiment of the present invention are shielded.
Figure 5:
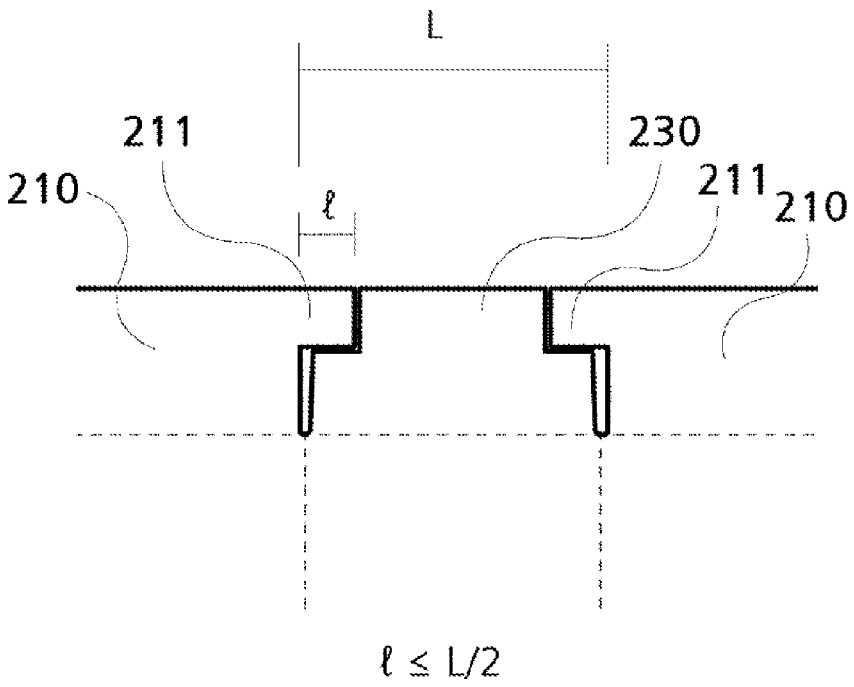
FIG. 5 is an exemplary view illustrating a structure of the adhesive wing portion of the foldable box having the adhesive wing portion according to the preferred embodiment of the present invention.
Figure 6:
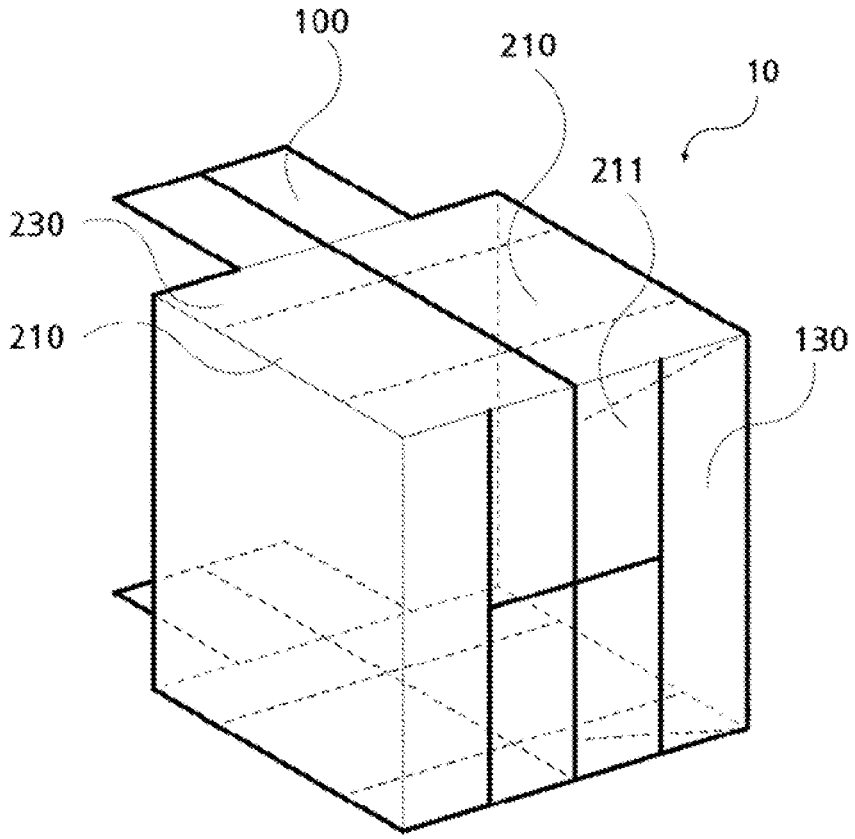
FIG. 6 is a perspective view illustrating an example where the length of the adhesive wing portion in the foldable box having the adhesive wing portion according to the preferred embodiment of the present invention is extended to the maximum.
Figure 7:
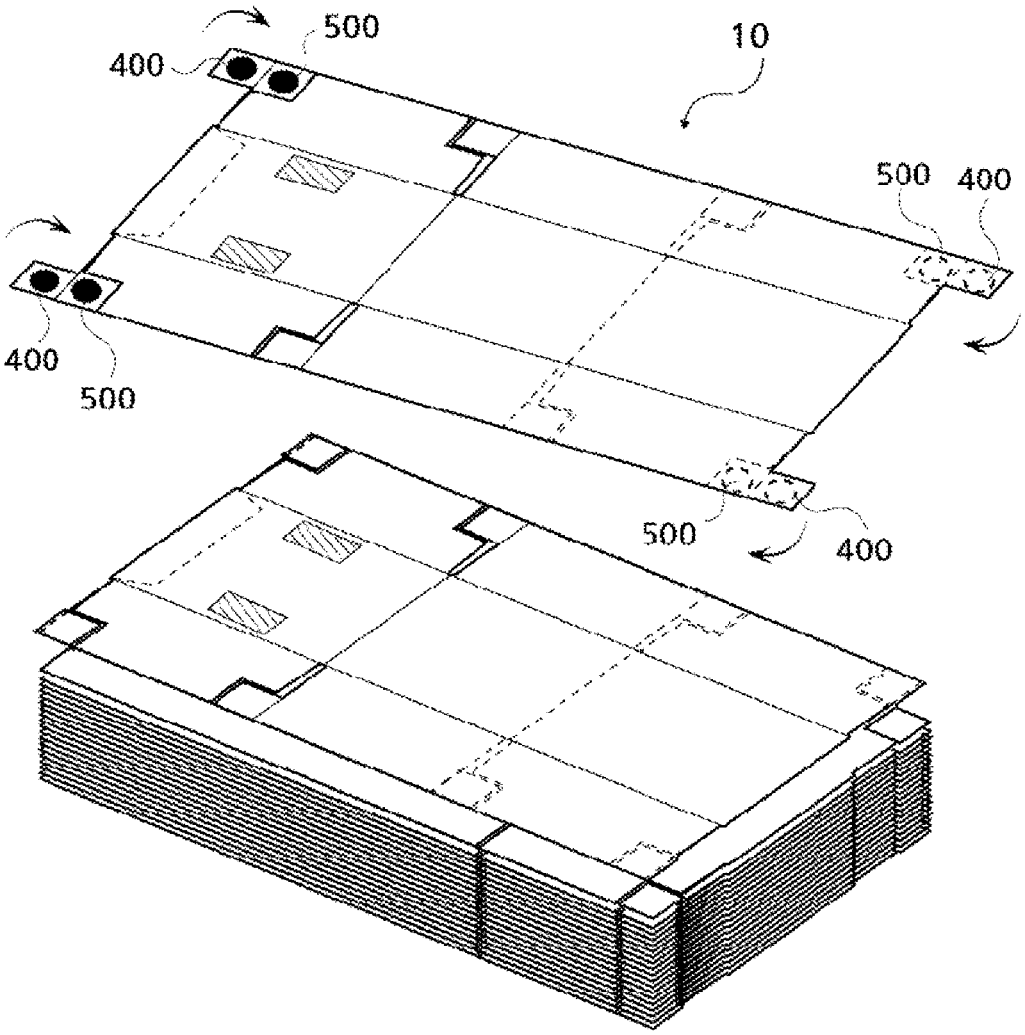
FIG. 7 is an exemplary view illustrating an example where the adhesive wing portion is folded in a state where the foldable box having the adhesive wing portion according to the preferred embodiment of the present invention is stacked.

FIG. 2 is a development view illustrating a foldable box having an adhesive wing portion according to a preferred embodiment of the present invention, FIG. 3 is an exemplary view illustrating a state where the foldable box having the adhesive wing portion according to the preferred embodiment of the present invention is folded, FIG. 4 is an exemplary view illustrating a state where upper and lower ends of the foldable box having the adhesive wing portion according to the preferred embodiment of the present invention are shielded, FIG. 5 is an exemplary view illustrating a structure of the adhesive wing portion of the foldable box having the adhesive wing portion according to the preferred embodiment of the present invention, FIG. 6 is a perspective view illustrating an example where the length of the adhesive wing portion in the foldable box having the adhesive wing portion according to the preferred embodiment of the present invention is extended to the maximum, and FIG. 7 is an exemplary view illustrating an example where the adhesive wing portion is folded in a state where the foldable box having the adhesive wing portion according to the preferred embodiment of the present invention is stacked.

First, the foldable box having the adhesive wing portion according to the preferred embodiment of the present invention is formed of a paper or plastic board.

Here, the foldable box is formed by cutting and folding one sheet of a board.

As illustrated in FIG. 2, the foldable box having the adhesive wing portion according to the preferred embodiment of the present invention includes side members 100, an upper member 200, and a lower member 300.

The side members 100 are formed as a transverse central portion of the board, and are folded respectively to form side surfaces of the box.

Here, the side members 100 include a pair of long-side side members 110 spaced apart from each other to form long side surfaces when the box is folded, and a pair of short-side side members 130 formed on side surfaces of the long-side side members 110 to form short side surfaces.

Further, the upper member 200 extends in an upper direction from the side member 100, and is divided by a cutting line along a folding direction.

The upper member 200 includes a long-side upper member 210 extending upwards from the long-side side member 110, and a short-side upper member 230 extending upwards from the short-side side member 130.

Thus, the upper member 200 forms the upper surface of the box when the box is folded along the folding line.

Further, the lower member 300 extends in the lower direction of the side member 100 to be divided along the folding direction by the cutting line.

The lower member 300 includes a short-side lower member 330 extending downwards from the short-side side member, and a short-side lower member 330 extending upwards from the short-side side member 130.

Thus, the lower member 300 forms the lower surface of the box when the box is folded along the folding line.

An adhesive part 150 is formed on a side of the side member 100 and is fixed by making one end of the side member 100 come into surface contact with the other folded end when the box is folded.

Meanwhile, in describing the foldable box according to the preferred embodiment of the present invention, by way of example, a case where the board is folded and the box is shielded will be described with reference to FIG. 3.

First, as described above, in order to shield the box, the upper member 200 and the lower member 300 are folded, thus shielding the box.

The short-side upper member 230 and the short-side lower member 330 are folded to be located inside the box, while the long-side upper member 210 and the long-side lower member 310 are folded to be located outside the box.

Furthermore, the long-side upper member 210 and the long-side lower member 310 may be folded to be located inside the box, while the short-side upper member 230 and the short-side lower member 330 may be folded to be located outside the box.

Meanwhile, according to the present invention, as the configuration for shielding the upper and lower portions of the box, the adhesive wing portion 211 is further included in any one of the long-side upper member 210 and the long-side lower member 310.

Hereinafter, the configuration for shielding the box will be described in detail.

According to the forming position of the adhesive wing portion, the folding positions of the upper member and the lower member are changed. Hereinafter, for example, a case where the short-side upper member 230 and the short-side lower member 330 are folded to be located inside the box and the long-side upper member 210 and the long-side lower member 310 are folded to be located outside the box, thus shielding the box.

First, the adhesive wing portion 211 extends outwards from each of the long-side upper member 210 and the long-side lower member 310 to be folded from the coupling end of each of the long-side upper member 210 and the long-side lower member 310 and be attached to the side member 100.

As illustrated in FIG. 4, the adhesive wing portion 211 extends to both sides of each of the long-side upper member 210 and the long-side lower member 310, and is formed using a cut surface that is cuts from each of the adjacent short-side upper member 230 and short-side lower member 330.

The adhesive wing portion 211 is formed on a side surface of each of the long-side upper member 210 and the long-side lower member 310 and the short-side upper member 230 and the short-side lower member 330 to be formed by the cut surface.

That is, the adhesive wing portion 211 is formed to correspond to a cut shape of the cut surface between the long-side upper member 210 and the long-side lower member 310 and between the short-side upper member 230 and the short-side lower member 330.

In order to place the adhesive wing portions 211 on both sides of each of the short-side upper member 230 and the short-side lower member 330, a cut part of a depressed shape corresponding to the shape of an outer part of each adhesive wing portion 211 is formed.

In other words, according to the present invention, in order to make the adhesive wing portion when the box is manufactured, the adhesive wing portion is formed of a board portion which is located at an inner position when the box is shielded and is unnecessary in function, so that the available area efficiency of the board is increased and the holding rate is reduced.

Meanwhile, as described above, the adhesive wing portion 211 is formed using some area of the adjacent short-side upper member 230 or short-side lower member 330.

Thus, according to the present invention, in order to achieve a maximum support force without using an additional board, the extension length of the adhesive wing portion 211 may be limited.

That is, according to the present invention, the extension length l of the adhesive wing portion 211 is formed using some area of the adjacent short-side upper member 230 or short-side lower member 330, as illustrated in FIG. 5. Preferably, the extension lengths which are equal to or less than a half of the width L of each of the short-side upper member 230 and the short-side lower member 330 are symmetrically formed.

Meanwhile, in the case of a square box as illustrated in FIG. 6, the adhesive wing portion 211 may be formed such that the length of the adhesive wing portion 211 extends to the maximum and thus ends of the adhesive wing portion 211 formed on the upper member 200 and the adhesive wing portion 211 formed on the lower member 300 meet each other.

In the case of the square box, the adhesive wing portion 211 may not only extend outwards from each of the long-side upper member 210 and the long-side lower member 310, but also may extend outwards from each of the short-side upper member 230 and the short-side upper member 230.

Thus, the adhesive wing portion 211 may be formed on any one of the long-side upper member 210, the long-side lower member 310, the short-side lower member 330 and the short-side lower member 330 to shield the box.

That is, in the case of the square box, since the adhesive wing portion 211 is formed on at least one of the upper member 200 and the lower member 300 regardless of the long side or the short side, the box can be effectively shielded.

The adhesive wing portion 211 may be attached using a separate adhesive means such as the adhesive tape.

Meanwhile, when the box is folded to shield the open surface, the adhesive wing portion 211 may be fixed to the side member 100 and may be configured so that the upper member 200 and the lower member 300 are not opened or closed.

To this end, the adhesive member may be provided on the inner surface of the adhesive wing portion 211 and fix the upper member 200 and the lower member 300 so that they are not opened or closed.

Further, the adhesive member may be provided on a side of the side member at which the adhesive wing portion 211 is folded and located.

Hereinafter, the configuration and various embodiments of the adhesive wing portion and the adhesive member for shielding the box will be described in more detail.

Here, since the adhesive wing portion 211 is attached to the side member 100 as described above, the adhesive member may use any one of an adhesive method, a Velcro method, and a snap-button method so that the upper member 200 and the lower member 300 are not opened or closed First, an example where the adhesive method is applied as the adhesive member will be described.

When the adhesive method is used as the adhesive member, the adhesive tape having an adhesive force by applying an adhesive thereto may be used so that the adhesive wing portion 211 is in surface contact with the side member 100 to be attached thereto.

Thus, in the embodiment using the adhesive member of the adhesive method so as to shield the box according to the present invention, the adhesive wing portion 211 is attached to the side member 100 using the adhesive tape to shield the box.

Meanwhile, if the adhesive member uses the adhesive tape of the adhesive method, an adhesive is used to achieve a sufficient fixing force. However, it has a drawback in that it is difficult to reuse the adhesive.

Thus, the adhesive tape of the adhesive method may be formed in multiple layers, so that it may be detachably attached multiple times.

Meanwhile, in another embodiment for shielding the box, the box may be configured to be detachably attached.

Next, an example where the Velcro method is applied as the fixing method of the adhesive member will be described.

Here, if the Velcro method is used as the adhesive member, Velcro tape formed of a hook surface or a ring surface may be used so that the adhesive wing portion 211 is fixed to the side member 100.

The hook surface of the Velcro tape is provided on the adhesive wing portion 211, and the ring surface is provided at a position where the adhesive wing portion 211 is folded and is in surface contact with the side member 100 to be in surface contact with the hook surface and thereby generate a fastening force.

Furthermore, the ring surface of the Velcro tape may be provided on the adhesive wing portion 211, and the hook surface may be provided at a position where the adhesive wing portion 211 is folded and is in surface contact with the side member 100 to be in surface contact with the ring surface and thereby generate a fastening force.

Thus, in another embodiment for shielding the upper surface of the box, the adhesive wing portion 211 is attached to a side surface to shield the open surface of the box using the fastening force generated when the hook surface of the Velcro tape is in surface contact with the ring surface thereof.

Therefore, according to another embodiment for shielding the upper surface of the box, since the adhesive wing portion 211 may be detachably attached to the side member 100 by the fastening force between the hook surface and the ring surface as the adhesive member of the Velcro method is used, it is possible to reuse the box.

Finally, an example where the snap-button method is applied as the adhesive-member fixing method will be described.

Here, if the snap-button method is applied as the adhesive-member, the snap button formed of a female snap button or a male snap button may be used so that the adhesive wing portion 211 is fixed to the side member 100.

The snap button is fixed by coupling the female snap button to the male snap button.

Here, the female snap button of the snap button is provided on the adhesive wing portion 211, while the male snap button coupled to the female snap button is provided at a position where the adhesive wing portion 211 is folded and is in surface contact with the side member 100.

Furthermore, the male snap button of the snap button may be provided on the adhesive wing portion 211, while the female snap button coupled to the male snap button may be provided at a position where the adhesive wing portion 211 is folded and is in contact with the side member 100.

Thus, according to a further embodiment for shielding the open part of the box, the adhesive wing portion 211 is attached to the side surface to shield the open part of the box using a coupling force between the female snap button and the male snap button.

Therefore, according to yet another embodiment for shielding the open part of the box, since the adhesive wing portion 211 may be detachably attached to the side member 100 by the coupling force between the female snap button and the male snap button as the adhesive member of the snap button method is used, it is possible to reuse the box.

Folding of adhesive wing portion

Meanwhile, if the foldable box having the adhesive wing portion is stacked and stored for the purpose of distribution, the adhesive wing portion 211 may extend and protrude outwards.

To this end, according to the present invention, the adhesive wing portion 211 may be configured to be stackable in the folded state.

Hereinafter, the configuration where the adhesive wing portion 211 is stackable in the folded state will be described with reference to the accompanying drawings.

FIG. 7 is an exemplary view illustrating an example where the adhesive wing portion is folded in the state where the foldable box having the adhesive wing portion according to the preferred embodiment of the present invention is stacked.

As illustrated in FIG. 7, the foldable box having the adhesive wing portion according to the preferred embodiment of the present invention may be configured such that the adhesive wing portion 211 protrudes, when the adhesive part formed on one side of the side member 100 is in contact with the other side of the side member 100 to stack the foldable box.

To this end, the fixing member for supporting the adhesive wing portion 211 may be provided on the inner surface of each of the long-side upper member 210 and the long-side lower member 310 having the adhesive wing portion 211 so that the adhesive wing portion 211 having the adhesive member is folded and fixed.

For example, as described above, when the adhesive member of the Velcro method is applied to the adhesive wing portion, the hook surface is attached to the adhesive wing portion 211 as described above, and the ring surface is attached to the long-side upper member 210 or the long-side lower member 310 where the adhesive wing portion 211 is in surface contact, so as to generate a fastening force at a position where the adhesive wing portion 211 is folded and is in contact with.

Furthermore, when the ring surface is attached to the adhesive wing portion 211, the hook surface may be attached to the adhesive wing portion 211.

Thus, when the box is stacked, the adhesive wing portion 211 is fixed while being in contact with the long-side upper member 210 or the long-side lower member 310.

Meanwhile, in order to fix the adhesive wing portion 211 to the inside of the long-side upper member 210 or the long-side lower member 310, the button method may be used as the adhesive member.

Thus, when the box is stacked, the adhesive wing portion 211 maintains a folded state to prevent it from being damaged, and maintains a rectangular shape without a protrusion to efficiently utilize space when the box is stacked.

Meanwhile, as described above, the adhesive wing portion may be formed in various shapes.

Hereinafter, in the foldable box having the adhesive wing portion according to the present invention, various embodiments of the adhesive wing portion will be described.

Figure 8:
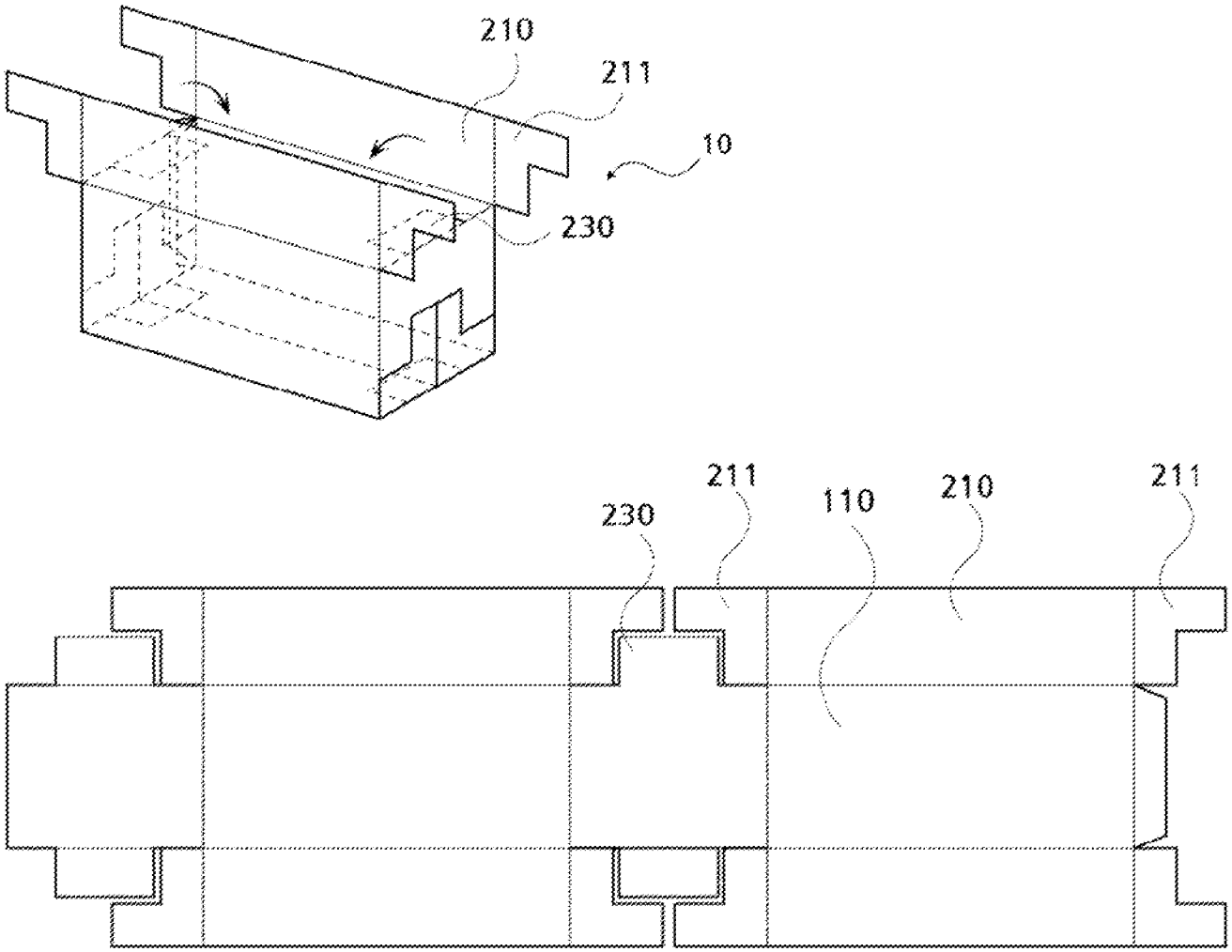
FIG. 8 is an exemplary view illustrating a foldable box having an adhesive wing portion according to another embodiment of the present invention.
Figure 9:
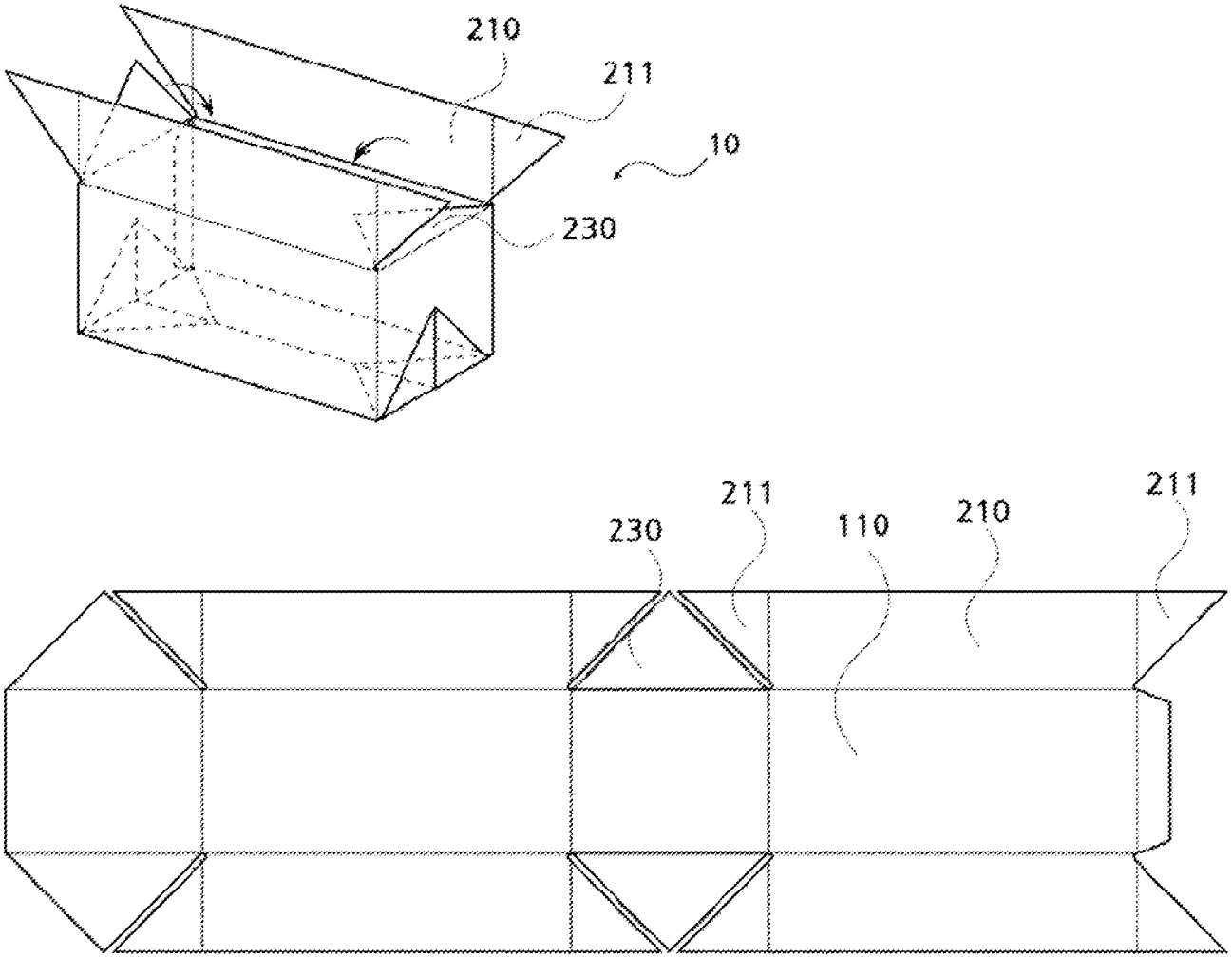
FIG. 9 is an exemplary view illustrating a foldable box having an adhesive wing portion according to a further embodiment of the present invention.

FIG. 8 is an exemplary view illustrating a foldable box having an adhesive wing portion according to another embodiment of the present invention, and FIG. 9 is an exemplary view illustrating a foldable box having an adhesive wing portion according to a further embodiment of the present invention.

First, the foldable box having the adhesive wing portion according to another embodiment of the present invention may be configured to improve the coupling force of the adhesive wing portion 211.

To this end, as illustrated in FIG. 8, the adhesive wing portion 211 may extend from each of the long-side upper member 210 and the long-side lower member 310, and may be formed in multiple layers such that a width thereof is reduced towards an end.

Thus, the foldable box having the adhesive wing portion 211 according to another embodiment of the present invention increases the coupling area of the adhesive wing portion 211, thus enhancing a coupling force due to an increase in coupling area of the adhesive wing portion 211.

Meanwhile, the foldable box having the adhesive wing portion according to another embodiment of the present invention may be configured such that the coupling force of the adhesive wing portion 211 is increased and detachment and attachment thereof are facilitated.

To this end, as illustrated in FIG. 9, the adhesive wing portion 211 may be diagonally formed such that a width thereof is reduced from each of the long-side upper member 210 and the long-side lower member 310 to an end and thereby the adhesive end converges on a point.

Here, in order to increase a load carried by the extended inside of the adhesive wing portion, it allows the extended inside to have a larger area in the same area, thus enhancing the coupling force.

To this end, an adhesion start portion at which the adhesive wing portion is folded and attachment is started maximizes the adhesive area, and the adhesive area of a detachment start portion is minimized, thus facilitating detachment.

That is, the adhesive force for the coupling end is enhanced when the box is shielded, and the adhesive force of the open end is reduced when the box is opened or closed.

Thus, the foldable box having the adhesive wing portion 211 according to a further embodiment of the present invention may maintain the coupling force of the adhesive wing portion 211, and may facilitate the detachment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL AVAILABILITY

The present invention provides a foldable box having an adhesive wing portion, in which an outwardly protruding adhesive wing portion is formed on a folding part of each of upper and lower surfaces, thus allowing the box to be shielded without separate tools. According to the present invention, the box is shielded using the adhesive wing portion, so that an upper or lower end of the box may be shielded without using separate adhesive tape, and thus usability can be increased.

The invention claimed is:

1. A foldable box having an adhesive wing portion, configured to form a rectangular box by cutting and folding one sheet of a board made of a paper or synthetic resin material, the foldable box comprising:

side members formed as a transverse central portion of the board, and folded respectively to form side surfaces of the box;

an upper member formed to extend in an upper direction of the side members, and divided by a cutting line along a folding direction to form an upper surface of the box; and a lower member formed to extend in a lower direction of the side members, and divided by a cutting line along a folding direction to form a lower surface of the box, wherein the adhesive wing portion, attached to the side members during shielding of upper and lower parts of the box, are extendedly formed on a side surface of at least one among the upper member and the lower member, wherein the side member comprises:

a pair of long-side side members spaced apart from each other to form long side surfaces when the box is folded; and a pair of short-side side members formed on side surfaces of the long-side side members to form short side surfaces, wherein an adhesive part is formed on a side of each of the long-side side members or a side of each of the short-side side members to be attached to the short-side side member or the long-side side member while being in contact with the long-side side member or the short-side side member when the box is folded, wherein the upper member and the lower member comprise:

a long-side upper member and a long-side lower member extending upwards and downwards from the long-side side member, respectively; and a short-side upper member and a short-side lower member extending upwards and downwards from the short-side side member, respectively, wherein the adhesive wing portion attached to each of the side members is extendedly formed on the long-side upper member and the long-side lower member, wherein a cut part of a depressed shape corresponding to a shape of an outer part of the adhesive wing portion is formed so that the adhesive wing portion is placed on both sides of the short-side upper member and the short-side lower member.

2. The foldable box of claim 1, wherein the adhesive wing portion is formed using a cut surface that is cut from each of the short-side upper member and the short-side lower member adjacent to the long-side upper member and the long-side lower member.

3. The foldable box of claim 2, wherein the adhesive wing portion is formed in a multi-layered structure such that a width thereof is reduced from a coupling end of each of the long-side upper member and the long-side lower member to an outer end so as to increase an adhesive area, when the upper and lower surfaces of the box are shielded.

4. The foldable box of claim 3, wherein an adhesive member having an adhesive force is provided on an inner surface of the adhesive wing portion or an outer surface of the short-side side member to attach the adhesive wing portion to the short-side side member, and the adhesive member comprises adhesive tape to which an adhesive is applied and which is attached to the short-side side member.

5. The foldable box of claim 3, wherein a detachable adhesive member is provided on the inner surface of the adhesive wing portion to attach the adhesive wing portion to the short-side side member, the side member comprises a fixing member coupled to the adhesive member at a point which the foldable wing portion is in surface contact with, when the box is folded, and each of the adhesive member and the fixing member comprises Velcro tape formed of a hook surface or a ring surface.

6. The foldable box of claim 3, wherein a detachable adhesive member is provided on the adhesive member to fix the adhesive wing portion to the short-side side member, the fixing member is provided on the side member to which the adhesive member is fixed at a point which the foldable wing portion is in surface contact with, when the box is folded, and the adhesive member and the fixing member comprise snap buttons composed of a female snap button having a coupling hole or a male snap button having a coupling step, respectively.

7. The foldable box of claim 1, wherein the adhesive wing portion is formed using a cut surface that is cut from each of the long-side upper member and the long-side lower member adjacent to the short-side upper member and the short-side lower member.

8. The foldable box of claim 7, wherein an adhesive member having an adhesive force is provided on an inner surface of the adhesive wing portion or an outer surface of the long-side side member to attach the adhesive wing portion to the long-side side member, and the adhesive member comprises adhesive tape to which an adhesive is applied and which is attached to the long-side side member.

9. The foldable box of claim 7, wherein a detachable adhesive member is provided on the inner surface of the adhesive wing portion to attach the adhesive wing portion to the long-side side member, the long-side side member comprises a fixing member coupled to the adhesive member at a point which the foldable wing portion is in surface contact with, when the box is folded, and each of the adhesive member and the fixing member comprises Velcro tape formed of a hook surface or a ring surface.

10. The foldable box of claim 7, wherein a detachable adhesive member is provided on the adhesive member to fix the adhesive wing portion to the short-side side member, the fixing member is provided on the long-side side member to which the adhesive member is fixed at a point which the foldable wing portion is in surface contact with, when the box is folded, and the adhesive member and the fixing member comprise snap buttons composed of a female snap button having a coupling hole or a male snap button having a coupling step, respectively.

* * * * *